US005412454A

United States Patent [19]

Asanae

[11] Patent Number: 5,412,454

[45] Date of Patent: May 2, 1995

[54] COMPACTM LOW PROFILE ELECROPHOTOGRAPHIC PRINTER

[75] Inventor: Masumi Asanae, Kumagaya, Japan

[73] Assignee: Hitachi Metals, Ltd., Tokyo, Japan

[21] Appl. No.: 91,062

[22] Filed: Jul. 14, 1993

[30] Foreign Application Priority Data

Jul. 15, 1992 [JP] Japan ..... 4-187992

[51] Int. Cl.[6] ..... G03G 15/00

[52] U.S. Cl. ..... 355/210; 361/221; 355/200

[58] Field of Search ..... 355/200, 210, 296–301; 361/221, 212

[56] References Cited

U.S. PATENT DOCUMENTS

| | | | |
|---|---|---|---|
| 4,363,070 | 12/1982 | Kisler | 361/212 |
| 4,785,324 | 11/1988 | Yamazaki et al. . | |
| 4,829,335 | 5/1989 | Kanemitsu et al. | 355/211 |
| 5,159,391 | 10/1992 | Koshi et al. | 355/271 |
| 5,196,892 | 3/1993 | Mitsuaki | 355/269 |
| 5,231,453 | 7/1993 | Nakai et al. | 355/210 |
| 5,231,456 | 7/1993 | Kikuchi et al. | 355/270 |
| 5,235,386 | 8/1993 | Yano et al. | 355/219 |

OTHER PUBLICATIONS

English Abstract of Japanese Patent Document 3—4276, Published Jan. 10, 1991.

*Primary Examiner*—R. L. Moses

*Attorney, Agent, or Firm*—Finnegan, Henderson, Farabow, Garrett & Dunner

[57] ABSTRACT

The electrophotographic printer of the present invention has a cylindrical, electrostatic latent image-bearing member, an electrostatic latent image-forming means, a cleaning/developing means which simultaneously serves as a cleaning means and a developing means, thereby contributing to a miniaturization of the electrophotographic printer and to a reduced consumption of a developer, a transfer means for transferring the developed image onto a recording medium, and a fixing means disposed downstream of the latent image-bearing member for heat-fixing the developed image onto the recording medium, wherein an outer diameter of the latent image-bearing member is 40 mm or less, an outer diameter of the magnet roll means is 30 mm or less, and a height of the image-forming unit is 100 mm or less.

4 Claims, 3 Drawing Sheets

COMPACTM LOW PROFILE ELECROPHOTOGRAPHIC PRINTER

BACKGROUND OF THE INVENTION

The present invention relates to an electrophotographic printer utilizing a means for forming an electrostatic latent image corresponding to information to be printed, on an image-bearing member, a means for developing the electrostatic latent image with a magnetic developer containing magnetic toner, a means for transferring the developed image to a recording medium, and a means for heat-fixing the developed image to the recording medium, and more particularly to an electrophotographic printer which has reduced thinness and improved portability.

In a conventional electrophotographic printer, an electrostatic latent image corresponding to a printer output (information to be printed) is generally formed on a cylindrical photosensitive drum, brought into contact with a magnetic brush of a magnetic developer conveyed on a developing roll containing a permanent magnet roll and disposed opposite the photosensitive drum, so that it is developed (visualized as a toner image). The developed image is then transferred onto a recording paper and heat-fixed.

The magnetic developer usable for a magnetic brush method as mentioned above is in many cases a two-component developer consisting of a magnetic carrier and a non-magnetic toner. However, in the case of using such a two-component developer, a concentration sensor and other members are required, failing to miniaturize an electrophotographic printer satisfactorily. Accordingly, a one-component developer consisting of a magnetic toner, or a magnetic developer consisting of a magnetic toner and a magnetic carrier is mostly used for the electrophotographic printer.

With the above magnetic developer, the electrophotographic printer can be miniaturized to some extent, but there is a limit in the conventional electrophotographic printer. Since there remain some toner on the photosensitive drum even after transferring a developed image to a recording medium, the conventional electrophotographic printer usually has a cleaning means for the removal of remaining toner, thereby needing more space in the vicinity of the photosensitive drum to place the cleaning means. This has been one of the causes that prevent conventional printers from being greatly miniaturized. Further, since the conventional electrophotographic printer has a heat-fixing means comprising a heat roll containing a heat source and a pressure roll for pressing the recording paper to the heat roll, and since these rolls are provided with paper-separating fingers and other accessories, it is impossible to reduce the height of the roll pair of the heat-fixing means drastically. Accordingly, it has been impossible to make the conventional electrophotographic printer have an extremely reduced thickness.

In the meantime, demands for a portable (hand-carrying) electrophotographic printer as well as for a stationary one have greatly increased recently. Although such a portable electrophotographic printer has already been commercialized for a type of using heat-sensitive papers, the information or image recorded on the heat-sensitive papers will disappear as the time goes. Accordingly, for the purpose of printing information which should be kept for a long period of time, the heat-sensitive paper type electrophotographic printer is not suitable.

OBJECT AND SUMMARY OF THE INVENTION

Accordingly, an object of the present invention is to provide a thin, hand-carrying electrophotographic printer which does not need a separate cleaning means and consumes less amount of toners, thereby obviating any problems inherent in the conventional electrophotographic printer.

To achieve the above object, the present invention provides an electrophotographic printer comprising an image-forming unit composed of a cylindrical electrostatic latent image-bearing member; an electrostatic latent image-forming means, a cleaning/developing means equipped with a magnet roll means onto which a magnetic developer containing a magnetic toner is attracted, and a transfer means for transferring the developed image on the surface of the electrostatic latent image-bearing member onto a recording medium, respectively disposed near the electrostatic latent image-bearing member; and a fixing means disposed downstream of the electrostatic latent image-bearing member for heat-fixing the developed image onto the recording medium, wherein the cleaning/developing means simultaneously performs two functions of developing the electrostatic latent image on the electrostatic latent image-bearing member and cleaning the toner remaining on the electrostatic latent image-bearing member after the last transfer of the developed image, and wherein an outer diameter of the electrostatic latent image-bearing member is 40 mm or less, an outer diameter of the magnet roll means is 30 mm or less, and a height of the image-forming unit is 100 mm or less, preferably 60 mm or less.

BRIEF DESCRIPTION OF THE DRAWINGS

FIG. 4 (*b*) is a schematic view showing another example of toner-discharging means additionally disposed in the vicinity of the electrostatic latent image-bearing member of the electrophotographic printer of the present invention; and FIG. 4 (*c*) is a schematic view showing a further example of toner-discharging means additionally disposed in the vicinity of the electrostatic latent image-bearing member of the electrophotographic printer of the present invention.

DETAILED DESCRIPTION OF THE INVENTION

The present invention will be described in detail below.

1. Overall Structure of the Printer

Before describing the details of the cleaning/developing means and the toner-discharging means, the overall structure of the electrophotographic printer will be explained briefly.

Figure 1:
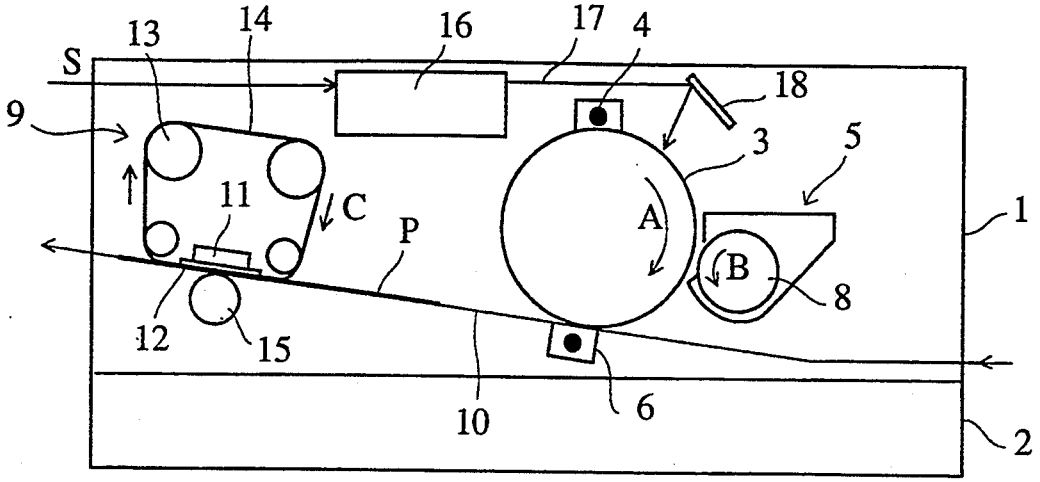
FIG. 1 is a schematic view showing an electrophotographic printer according to the present invention.

Referring to FIG. 1, the image-forming unit 1 integrally mounted to a control unit 2 comprises a cylindrical electrostatic latent image-bearing member 3 having an outer surface coated with a photosensitive layer (not shown) made of zinc oxide or an organic semiconductor, which is rotatable in the direction shown by the arrow A. Disposed in the vicinity of an outer surface of the cylindrical electrostatic latent image-bearing member 3 are a charging means 4, a cleaning/developing means 5, and a transfer means 6. Although the charging means 4 and transfer means 6 can be of a contact type, it is preferable to use those of corona discharge type to effectively miniaturize the electrophotographic printer of the present invention. The cleaning/developing means 5 contains a magnet roll means 8 composed of a sleeve rotatable in the direction shown by the arrow B and a stationary permanent magnet disposed in the sleeve.

A fixing means 9 is disposed on the downstream side of the cylindrical electrostatic latent image-bearing member 3 along a path 10 of a recording paper P in the image-forming unit 1. The fixing means 9 is constituted by a heating means comprising a substrate 11 made of heat-resistant, insulating material such as alumina and a heater means 12 made of an electric resistance material and formed on the substrate 11, a plurality of rollers 13, an endless belt 14 movable along a path around the heater means 12 and the rollers 13 in the direction shown by the arrow C, and a rotatable pressure roll 15 disposed in the vicinity of the heater means 12 for pressing the recording paper P to the heater means 12 via the belt 14.

The endless belt 14 may have a thickness of 100 μm or less, preferably 20–50 μm, and may be made of a heat-resistant material such as polyimide, polyetherimide, etc. The endless belt 14 is coated with a releasing layer made of fluoroplastics such as polytetrafluoroethylene (PTFE), perfluoroalkoxy resins (PFA), etc. at a thickness of 1–20 μm, particularly about 10 μm on the surface facing the toner image on the recording medium P (lower surface in FIG. 1). The pressure roll 15 is coated with an elastic layer having a good releasing property such as a silicone rubber, etc. The pressure roll 15 may come into contact with the heater means 12 via the belt 14 and the paper P at a linear pressure of 0.1–1 kg/cm, for instance, 0.5 kg/cm.

Incidentally, the belt 14 is not restricted to an endless belt, but the belt 14 may have a limited length, if it is wound around a pair of rolls apart from each other, and if these rolls are rotated in the same direction. In this case, the belt 14 is wound around one roll while it is unwound from another roll at any time, whereby the belt 14 moves back and forth through a gap between the heating member 12 and the pressure roll 15.

A laser scanner 16 is mounted to an upper part of the image-forming unit 1. In response to an electric signal S corresponding to information or image to be printed, the laser scanner 16 supplies a laser beam 17 toward a mirror 18, by which the laser beam 17 is reflected and impinges a surface of the cylindrical electrostatic latent image-bearing member 3. The driving mechanism (not shown) and the laser scanner 16 contained in the image-forming unit 1 are electrically connected to the control unit 2, so that their operations are controlled.

The electrophotographic printer having the above structure is operated as follows:

After putting the image-forming unit 1 into an operating condition via the control unit 2, an electric signal S corresponding to information or image is supplied to the laser scanner 16. Next, the electrostatic latent image-bearing member 3 is charged uniformly by a charging means 4, and the laser beam 17 generated by the laser scanner 16 according to the electric signal S is impinged onto the charged surface of the electrostatic latent image-bearing member 3 to form an electrostatic latent image. Then, by the cleaning/developing means 5, the electrostatic latent image is developed with a magnetic toner conveyed by the magnet roll means 8 comprising a permanent magnet member and a cylindrical sleeve rotating relatively to the magnet member. The developed image (toner image) is then transferred onto a recording paper P conveyed along the recording paper path 10 by means of the transfer means 6. Incidentally, the magnetic toner remaining on the electrostatic latent image-bearing member 3 after the transfer of the developed image is rubbed off by the magnetic brush formed on the magnet roll means 8 at the time when the next electrostatic latent image is developed with the magnetic brush.

The recording paper P carrying the toner image is conveyed to the fixing means 9, where the recording paper P passes through a gap between the belt 14 movable in contact with the heating member 12 and the pressure roll 15. Since heat supplied from the heating member 12 is transmitted to the toner image on the recording paper P via the belt 14, a binder resin in the magnetic toner is melted, whereby the toner image is fixed to the recording paper P.

Figure 3:
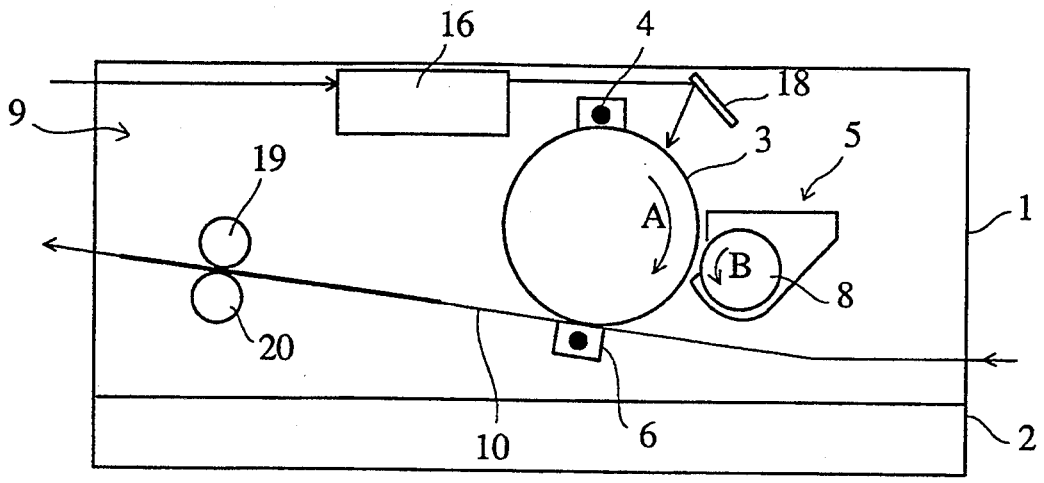
FIG. 3 is a schematic view showing another electrophotographic printer according to the present invention.

Another electrophotographic printer of the present invention is shown in FIG. 3 in which the same reference numerals are assigned to the same components as in FIG. 1. In this electrophotographic printer, the fixing means 9 is constituted by a heating roll 19 and a pressure roll 20 both rotatable in pressed contact with each other. Each of the heating roll 19 and the pressure roll 20 has an outer diameter of 20 mm or less, preferably 10–20 mm, and they are pressed to each other at a linear pressure of 0.1–1 kg/cm, preferably 0.5 kg/cm.

The heating roll 19 may be of a so-called direct heat type having an outer surface provided with a heat-generating layer made of an electric resistance material. Specifically, the heating roll 19 may be composed of a cylindrical core member made of aluminum, etc., a heating layer made of an electric resistance material and formed on an outer surface of the core member, and a releasing layer made of PTFE having a thickness of 1–20 μm, particularly about 10 μm and formed on an outer surface of the heating layer. On the other hand, the pressure roll 20 may be composed of a cylindrical core member made of the same material as in the heating roll 19, and an outer layer made of a silicone rubber and formed on an outer surface of the core member.

The heating roll 19 may also be constituted by a core member made of a ceramic material and a heating member embedded in the core member.

2. Cleaning/Developing Means

Figure 2:
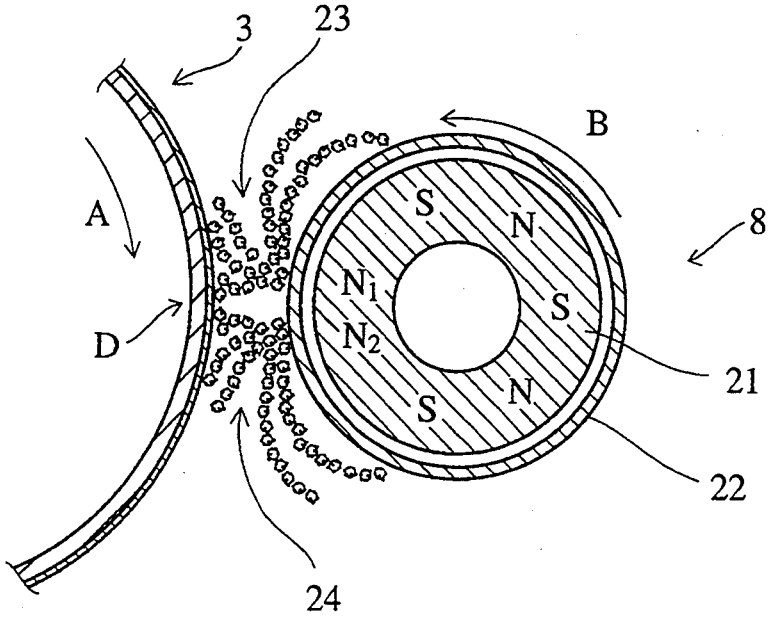
FIG. 2 is an enlarged view showing a magnet roll means in the electrophotographic printer shown in FIG. 1.

FIG. 2 shows the magnet roll means 8 of the cleaning/developing means 5 in detail. The magnet roll means 8 is disposed near the electrostatic latent image-bearing member 3 to form a developing region D where the magnet roll means 8 and the electrostatic latent image-bearing member 3 oppose each other, and constituted by a cylindrical permanent magnet member 21 made of a sintered permanent magnet such as hard ferrite or a resin-bonded permanent magnet and a sleeve 22 made of a non-magnetic material such as aluminum alloy, stainless steel, etc.

The permanent magnet member 21 has a plurality of axially extending magnetic poles on the outer surface, and is kept at a fixed position so that one certain pole (for example, N pole) is opposed to the electrostatic latent image-bearing member 3. The magnetic pole opposing the electrostatic latent image-bearing member 3 is not restricted to one, and therefore, two magnetic poles of the same polarity separated with a small interval can be opposed to the electrostatic latent image-bearing member 3 as shown in FIG. 2, thereby producing two peaks in the magnetic field strength distribution. The sleeve 22 disposed around the permanent magnet member 21 is rotated counterclockwise, thereby conveying a magnetic toner attracted onto the sleeve to the developing region D facing the electrostatic latent image-bearing member 3.

Due to the above construction, the magnetic poles $N_1$, $N_2$ respectively form magnetic brushes 23, 24 distributed in a wide range in the developing region D where these magnetic brushes come into slide contact with the surface of the electrostatic latent image-bearing member 3. Accordingly, a magnetic toner remaining in an area not bearing a new electrostatic latent image on the surface of the electrostatic latent image-bearing member 3 after the last transfer of a developed image is rubbed off therefrom when it comes into contact with the magnetic brushes 23 and 24. At the same time, the newly formed electrostatic latent image on the surface of the electrostatic latent image-bearing member 3 is developed with the magnetic brushes 23 and 24. Incidentally, the remaining toner removed from the electrostatic latent image-bearing member 3 is partly reused for developing the newly formed electrostatic latent image and partly brought into a developer container (not shown) by the rotation of the sleeve 22, thereby serving again as a developer for the subsequent development of electrostatic latent images.

3. Toner-Discharging Means

In the present invention, a toner-discharging means can be additionally disposed around the electrostatic latent image-bearing member 3 to improve the cleaning efficiency of the cleaning/developing means 5.

Figure 4:
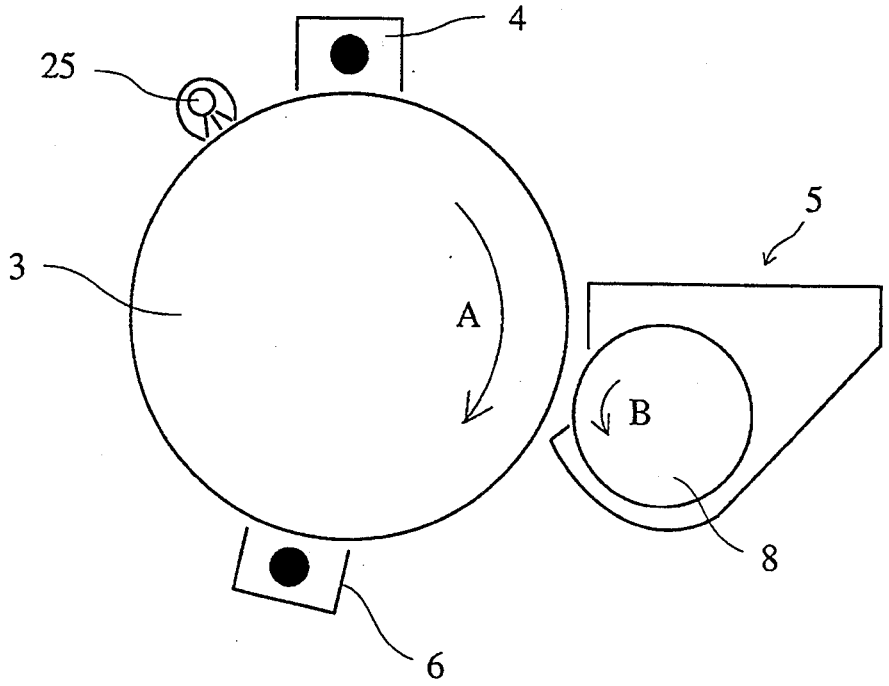
FIG. 4 (*a*) is a schematic view showing an example of toner-discharging means additionally disposed in the vicinity of the electrostatic latent image-bearing member of the electrophotographic printer of the present invention.
Figure 4:
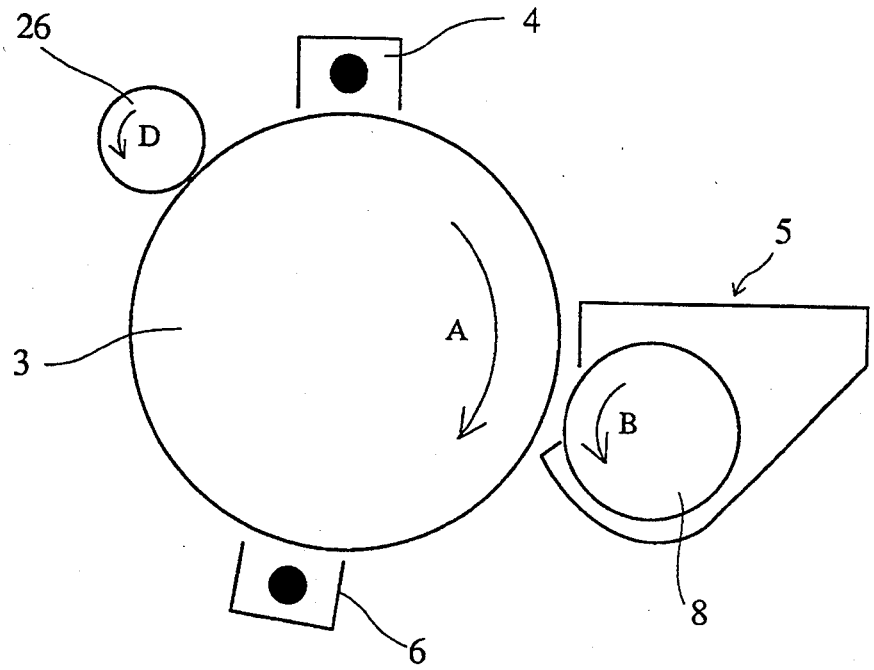
Figure 4:
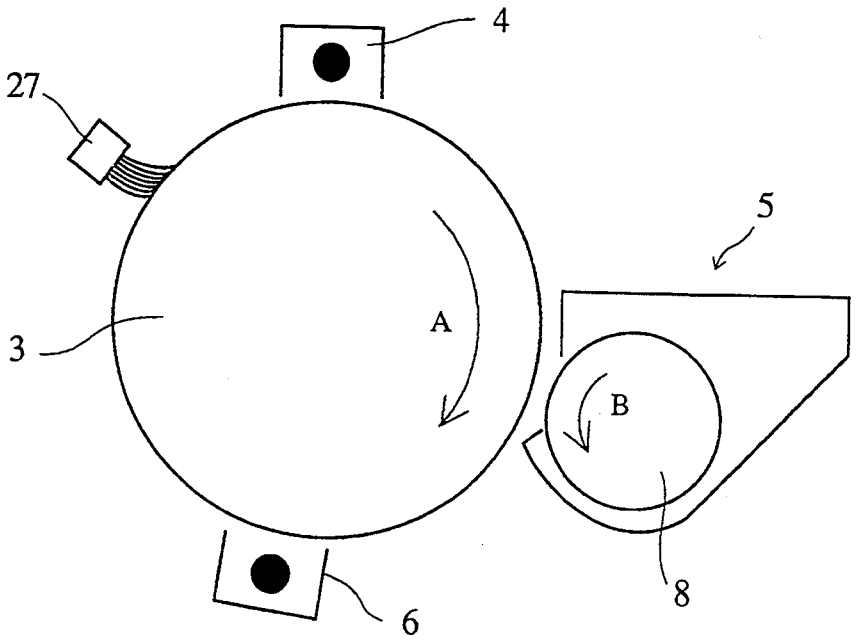

FIG. 4 (*a*) shows an example of the toner-discharging means applicable in the present invention. In this case, the toner-discharging means is a discharging lamp 25, namely a lamp lightening the overall surface of the electrostatic latent image-bearing member 3, which is disposed around the electrostatic latent image-bearing member 3 on the circumferentially downstream side of the transfer means 6. By being exposed to the discharging lamp 25, the electric charge of the electrostatic latent image-bearing member 3 is dissipated so that the electric charge of the remaining toner partly disappears. This allows the magnetic brushes 23 and 24 formed on the magnet roll means 8 to more effectively remove the remaining toner from an area on the surface of the electrostatic latent image-bearing member 3 where no electrostatic latent image is formed.

FIG. 4 (*b*) shows another example of the toner-discharging means usable in the present invention. In this case, the toner-discharging means is a discharging roll 26 made of a conductive material, which is disposed around the electrostatic latent image-bearing member 3 on the circumferentially downstream side of the transfer means 6 and rotated in the direction shown by the arrow D. The discharging roll 26 is arranged to be in slide contact with the surface of the electrostatic latent image-bearing member 3 and applied a voltage of 0–400V. In the case where some extent of voltage is applied, it should be applied in such a manner that the surface of the discharging roll 26 has a charge opposite to that of the remaining toner. For instance, when the remaining toner has a negative charge, the surface of the discharging roll 26 should have a positive charge. With this construction, the electric charge of the remaining toner is dissipated, thereby allowing the magnetic brushes 23 and 24 to more effectively remove the remaining toner from an area on the surface of the electrostatic latent image-bearing member 3 where no electrostatic latent image is formed. Incidentally, since the remaining toner is physically rubbed by the discharging roll 26, the adhesion of the remaining toner to the surface of the electrostatic latent image-bearing member 3 is decreased. This also contributes to the cleaning efficiency.

FIG. 4 (*c*) shows a further example of the toner-discharging means usable in the present invention. In this case, the toner-discharging means is a discharging brush 27 made of a conductive material, which is disposed around the electrostatic latent image-bearing member 3 on the circumferentially downstream side of the transfer means 6. The discharging brush 27 is also arranged to be in slide contact with the electrostatic latent image-bearing member 3 and applied a voltage of 0–400V in the same manner as in the case of the discharging roll 26. The discharging brush 27 performs the same functions as the discharging roll 26.

In practice, the discharging lamp 25 is used in combination with the discharging roll 26 or the discharging brush 27. In this case, the discharging lamp 25 is disposed on the circumferentially upstream side of the discharging roll 26 or the discharging brush 27.

4. Parameters

In the electrophotographic printer having the above described constructions, when the electrostatic latent image-bearing member 3 has an outer diameter exceeding 40 mm, and when the magnet roll means 8 has an outer diameter exceeding 30 mm, the image-forming unit 1 becomes too high, failing to make the electrophotographic printer thin and portable. Therefore, the electrostatic latent image-bearing member 3 should have an outer diameter of 40 mm or less, preferably 30 mm or less, and the magnet roll means 8 should have an outer diameter of 30 mm or less, preferably 20 mm or less, so that the height of the image-forming unit 1 can be made as small as 100 mm or less, preferably 60 mm or less. A peripheral speed of the image-bearing member is preferably 60 mm/sec or less, more preferably 20–50 mm/sec. The fixing speed is thus preferably 60 mm/sec or less, more preferably 20–50 mm/sec. With these peripheral speed and fixing speed (both called "process speed"), the electrostatic latent image-bearing member 3 having as small an outer diameter as 40 mm or less can be used, and the convey speed of the magnetic developer can be lowered, which makes it possible to reduce the outer diameter of the magnet roll means 8 to 30 mm or less. Therefore, a torque necessary for rotating the magnet roll means 8 can be reduced, which in turn makes the driving means smaller.

5. Magnetic Developer

The magnetic developer usable in the present invention is (i) a magnetic toner consisting mainly of a binder resin and a magnetic powder, or (ii) a mixture of a magnetic toner and a magnetic carrier. In the case where the magnetic developer (ii) is used, the toner concentration is set within the range of 10–90 weight %, preferably 10–60 weight %, more preferably 15–30 weight %. Examples of the binder resins include styrene resins such as polystyrene, styrene-acrylic copolymers, styrene-butadiene copolymers, etc., and other known resins.

The magnetic powder may be made of compounds or alloys containing ferromagnetic metals such as iron, cobalt, nickel, etc., for instance, ferrite, magnetite, etc. To disperse the magnetic powder in the binder resin uniformly, it is preferable that the magnetic powder has an average diameter of 0.01–3 μm. The content of the magnetic powder in the magnetic toner is preferably within the range of 10–80 weight %, more preferably 20–60 weight %.

The magnetic toner used in the present invention may contain various additives like usual developers, including charge-controlling agents such as nigrosine dies or azo dies containing metals, releasing agents such as olefin polymers, fluidity improvers, fillers, etc. In order to avoid the decrease in a fixability, the total amount of the additives is preferably 15 weight % or less.

The magnetic toner can be prepared by known methods such as a pulverization method, a spray-drying method, or a suspension polymerization method. The volume average diameter of the magnetic toner is preferably within the range of 5–15 μm, more preferably 7–10 μm in view of the image quality.

The magnetic carrier usable in the present invention is produced from iron powder, iron oxide (for instance, magnetite), soft ferrite (for instance, Ni—Zn ferrite, Mn—Zn ferrite, Cu—Zn ferrite, Ba—Ni—Zn ferrite), magnetic powder bonded with resin binders, etc. To prevent carrier adhesion and fogging, the magnetic carrier preferably has a magnetization (δs) of 30–90 emu/g (measured in a magnetic field (maximum: 10 kOe) by a vibration-type magnetometer (Model VS-3, manufactured by Toei Industry Co., Ltd.) and an average diameter of 20–105 μm. Also, magnetic powder coated with a resin having an average diameter of 10–100 μm may be used.

The intrinsic volume resistance of the magnetic carrier is preferably $10–10^6$ Ω. cm. If the intrinsic volume resistance of the magnetic carrier is less than 10 Ω. cm, the magnetic carrier would move to the surface of the image-bearing member 3, resulting in a deteriorated image quality. On the other hand, if the intrinsic volume resistance of the magnetic carrier is larger than 10Ω.cm, the efficiency in cleaning the remaining toners is low. Such magnetic carrier can be produced by attaching conductive particles such as carbon black, etc. to an outer surface of a resin-coating formed on a magnetic ferrite powder in such an amount that the resulting magnetic carrier has the preferred intrinsic volume resistance.

The present invention will be explained in further detail by way of the following Examples.

EXAMPLE 1

In the electrophotographic printer having a construction shown in FIG. 1, the height of the image-forming unit 1 could be reduced to as small as 55 mm, by reducing the outer diameter of the electrostatic latent image-bearing member 3 having a photosensitive layer made of an organic semiconductor to 30 mm and the outer diameter of the developing roll 8 in the cleaning-/developing means 5 to 18 mm. Such a small electrophotographic printer is easily carried with a hand.

In this small electrophotographic printer, the following operating conditions were used:

Peripheral speed of electrostatic latent image-bearing member 3–20 mm/sec.,

Fixing temperature=130° C., and

Pressing force of pressure roll 15=0.5 kg/cm.

Image formed on the recording paper under these conditions showed good image density and resolution with good fixability.

EXAMPLE 2

In the electrophotographic printer having a construction shown in FIG. 3, image was formed under the same conditions as in Example 1. As a result, it was confirmed that as good image as in Example 1 could be formed.

As described above in detail, the electrophotographic printer according to the present invention can be made thin because of the above-described structure, whereby it can serves as a portable printer. Further, since a magnetic developer remaining on the electrostatic latent image-bearing member 3 after the transfer of the developed image can be removed therefrom at the position of cleaning/developing means, the developer can be used again for the subsequent development of the electrostatic latent images, thereby reducing the consumption of the magnetic developer. Also, since rollers in the fixing means have small diameters, the recording medium would not be wound around the rolls in the fixing means even without separation fingers. Therefore, the fixing means can have a simplified structure, making it possible to reduce the weight and cost of the image-forming unit.

What is claimed is:

1. A vertically compact electrophotographic printer comprising an image-forming unit having a cylindrical electrostatic latent image-bearing member; an electrostatic latent image-forming means, a cleaning/developing means equipped with a magnet roll means onto which a magnetic developer containing a magnetic toner is attracted, and a transfer means for transferring the developed image on the surface of said electrostatic latent image-bearing member onto a recording medium, respectively disposed near said electrostatic latent image-bearing member; and fixing means, disposed downstream of said electrostatic latent image-bearing member, for heat-fixing said developed image onto said recording medium, said cleaning/developing means simultaneously performing two functions of cleaning the toner remaining on said electrostatic latent image-bearing member after the previous transfer of the developed image and developing said electrostatic latent image on said electrostatic latent image-bearing member, and the outer diameter of said electrostatic latent image-bearing member being 40 mm or less, the outer diameter of said magnet roll means being 30 mm or less, the height of said image-forming unit being 100 mm or less, and the peripheral speed of said electrostatic latent image-bearing member being 60 mm/sec or less.

2. The electrophotographic printer according to claim 1, further comprising a means lightening the overall surface of said electrostatic latent image-bearing member and disposed around said electrostatic latent image-bearing member on circumferentially downstream side of said transfer means.

3. The electrophotographic printer according to claim 1, further comprising a toner-discharging means, which is made of a conductive material and disposed around said electrostatic latent image-bearing member on circumferentially downstream side of said transfer means so that it is in slide contact with the surface of said electrostatic latent image-bearing member.

4. A vertically compact electrophotographic printer comprising an image-forming unit having a cylindrical electrostatic latent image-bearing member; an electrostatic latent image-forming means, a cleaning/developing means equipped with a magnet roll means including a magnet roll spaced from said image-bearing member onto which a magnetic developer containing a magnetic toner is attracted for forming a magnetic brush, said magnetic brush providing said cleaning and developing, and a transfer means for transferring the developed image on the surface of said electrostatic latent image-bearing member onto a recording medium, respectively disposed near said electrostatic latent image-bearing member; and fixing means disposed downstream of said electrostatic latent image-bearing member for heat-fixing said developed image onto said recording medium, said cleaning/developing means simultaneously performing two functions of cleaning the toner remaining on said electrostatic latent image-bearing member after the previous transfer of the developed image and developing said electrostatic latent image on said electrostatic latent image-bearing member, and said electrostatic latent image-bearing member having an outer diameter of 40 mm or less, said magnet roll having an outer diameter of 30 mm or less, and said image-forming unit having a height of 100 mm or less, wherein the peripheral speed of said electrostatic latent image-bearing member is 60 mm/sec or less.

* * * * *

UNITED STATES PATENT AND TRADEMARK OFFICE

CERTIFICATE OF CORRECTION

PATENT NO. : 5,412,454

DATED : May 2, 1995

INVENTOR(S) : M. Asanae

It is certified that error appears in the above-identified patent and that said Letters Patent is hereby corrected as shown below:

On title page, item [54] and col. 1,

In the title, line 1, "COMPACTM" should read --COMPACT,--;

line 2, "ELECROPHOTOGRAPHIC" should read --ELECTROPHOTOGRAPHIC--.

Signed and Sealed this

Twenty-seventh Day of June, 1995

Bruce Lehman

*Attest:*

BRUCE LEHMAN

*Attesting Officer*

*Commissioner of Patents and Trademarks*